US006443716B1

(12) United States Patent
Yoshioka

(10) Patent No.: US 6,443,716 B1
(45) Date of Patent: Sep. 3, 2002

(54) ELECTRIC MOTOR-DRIVEN FUEL PUMP

(75) Inventor: Hiroshi Yoshioka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/856,306

(22) PCT Filed: Sep. 30, 1999

(86) PCT No.: PCT/JP99/05361

§ 371 (c)(1),
(2), (4) Date: May 21, 2001

(87) PCT Pub. No.: WO01/23739

PCT Pub. Date: Apr. 5, 2001

(51) Int. Cl.[7] ..... F04B 17/03
(52) U.S. Cl. ..... 417/423.7
(58) Field of Search ..... 310/154.01, 154.16; 417/365, 423.1, 423.7, 423.12

(56) References Cited

U.S. PATENT DOCUMENTS 5,160,249 A 11/1992 Iwai et al.
5,221,178 A 6/1993 Yoshioka et al.
5,391,062 A 2/1995 Yoshioka
5,971,687 A * 10/1999 Ito et al. ..... 417/423.7

FOREIGN PATENT DOCUMENTS

| | | |
|---|---|---|
| JP | 7-3239 | 8/1991 |
| JP | 4-200252 | 7/1992 |
| JP | 4-200253 | 7/1992 |
| JP | 2510153 | 4/1996 |

* cited by examiner

*Primary Examiner*—Michael Koczo
(74) *Attorney, Agent, or Firm*—Sughrue Mion, PLLC

(57) ABSTRACT

Permanent magnets (30, 31) are placed in both sides on the basis of a centerline of a rotor (16) perpendicular to a direction of a load applied to an impeller (4) by a pressure distribution within a pump flow path (7), and also an axial center **(31*a*) of the permanent magnet (31) is placed with the axial center offset to the side of the impeller (4) from an axial center (30*a*) of the other permanent magnet (30) and a turning moment is generated on the rotor (16) and thereby a load applied to bearings (17, 18)** is reduced.

4 Claims, 6 Drawing Sheets

ELECTRIC MOTOR-DRIVEN FUEL PUMP

TECHNICAL FIELD

This invention relates to an electric motor-driven type fluid pump, and particularly to an electric motor-driven fuel pump for forcedly feeding fuel from a fuel tank to an engine in an internal combustion engine for vehicle.

BACKGROUND ART

FIG. 5 is a vertical sectional view showing a conventional electric motor-driven fuel pump disclosed in, for example, JP-B-7-3239, and FIG. 6 is an enlarged sectional view taken along line VI—VI of FIG. 5, and FIG. 7 is an illustration of a radial load distribution occurring in a pump flow path, and FIG. 8 is an illustration of bearing repulsion forces with respect to a load applied to an impeller.

In the drawings, numeral 1 shows an assembly of a pump casing, and this pump casing assembly 1 comprises a pump casing body 2 and a cover 3, and a disk-shaped impeller 4 having blades 5 along the outer circumferential edge is held in the pump casing assembly 1, and this impeller 4 is rotatably supported by a center shaft 6 described below.

The pump casing assembly 1 holds a pump flow path 7 with a circular arc band shape extending along the blades 5 of the impeller 4, and a suction port 8 and a discharge port 9 are opened in both ends of the pump flow path 7. Also, a center shaft 6 of a rotor 16 of an electric motor 15 is fitted in the center of the impeller 4, and both ends of the rotor 16 are rotatably supported by a bearing 17 and a bearing 18 provided in each of the pump casing assembly 1 and a bracket 24.

The pump casing assembly 1 and an end cover 19 are mutually connected by a cylindrical yoke 20 of the electric motor 15, and a permanent magnet 25 is annularly provided in an inner circumference of the yoke 20, and the rotor 16 is held inside this permanent magnet 25. Also, a liquid chamber 21 for storing fuel discharged from the discharge port 9 is provided between the pump casing assembly 1 and the end cover 19, and this liquid chamber 21 is in communicative connection with a liquid outlet 23 having a check valve 22 provided in the end cover 19, and the bracket 24 is provided with a brush 27 for feeding for sliding to a commutator 26 for supplying a current to a winding (not shown) of the rotor 16.

Next, operations of the conventional electric motor-driven fuel pump will be described.

In the electric motor-driven fuel pump constructed as described above, by rotating and driving (FIG. 6) the impeller 4 in a clockwise direction by the electric motor 15, fuel is sucked from the suction port 8 to one end of the pump flow path 7, and this fuel is increased in pressure while flowing through the pump flow path 7 in a clockwise direction and passes the liquid chamber 21 from the discharge port 9 of the other end and is discharged from the liquid outlet 23 through the check valve 22.

Incidentally, at the time of the increase in pressure, in the outer circumferential edge of the impeller 4, a radial load distribution 10 (FIG. 7) by a pressure distribution increasing from the suction port 8 toward the discharge port 9 occurs within the pump flow path 7 and as the resultant force, a radial load 11 (hereinafter called "impeller load 11") acts on the impeller 4. As a result of that, while the impeller load 11 is applied to the center shaft 6 of the rotor 16 fitted in the impeller 4, bearing repulsion forces 12, 13 (FIG. 8) act on the center shaft 6 from the bearing 17 and the bearing 18 rotatably supporting the center shaft 6. At the same time, a bearing load with the same size as that of the bearing repulsion forces 12, 13 in the opposite direction of the bearing repulsion forces 12, 13 acts on the bearing 17 and the bearing 18.

For use as a fuel pump of an internal combustion engine for vehicle, for example, in the pump in which a discharge pressure at the time of discharging fuel from the liquid outlet 23 is 250 kPa, the impeller load 11 reaches as large as about 1 kgf, and a discharge pressure of the fuel pump tends to be increasing year after year for the purpose of improvements in efficiency of the internal combustion engine for vehicle for supplying the fuel and exhaust gas, etc. and the impeller load is also increasing accordingly.

Since the conventional electric motor-driven fuel pump is constructed as described above, when a load applied to the bearings 17, 18 by the impeller load 11 increases, power consumption of the electric motor 15 increases due to an increase in a sliding resistance between the center shaft 6 and the bearings 17, 18, and efficiency of the electric motor-driven fuel pump is reduced. Also, there was a problem that wear in a contact portion with the center shaft 6 of the bearings 17, 18 increases.

This invention is implemented to solve such problems, and an object of the invention is to obtain an electric motor-driven fuel pump wherein the efficiency of the fuel pump is increased and wear in bearings is decreased by reducing a bearing load by an impeller load.

DISCLOSURE OF THE INVENTION

With an electric motor-driven fuel pump according to this invention, in the electric motor-driven fuel pump comprising a disk-shaped impeller having blades in the outer circumferential edge, a pump casing assembly which rotatably supports the impeller and provides a pump flow path with a circular arc band shape extending along the blades of the impeller and a suction port and a discharge port opened in both ends of said pump flow path, a rotor having a center shaft fitted in the center of the impeller and a core fixed in said center shaft, bearings for rotatably supporting the center shaft of the rotor, and a pair of permanent magnets concentrically provided in an outer circumference of the rotor, and the permanent magnets are placed so that a load of a direction opposite to a direction of a load applied to the impeller by a pressure distribution within the pump flow path is generated in the rotor.

Also, the permanent magnets are placed in both sides on the basis of a centerline of the rotor perpendicular to a direction of a load applied to the impeller, and also as viewed from the side generating the load, an axial center of the opposite permanent magnet is placed with the axial center offset to the side of the impeller from an axial center of the other permanent magnet.

Also, an offset distance between an axial center of one permanent magnet and an axial center of the core is equal to an offset distance between an axial center of the other permanent magnet and the axial center of the core, and offset directions are mutually the opposite directions.

Also, the permanent magnet close to the impeller is positioned by an adjusting protrusion.

BEST MODE FOR CARRYING OUT THE INVENTION

Figure 1:
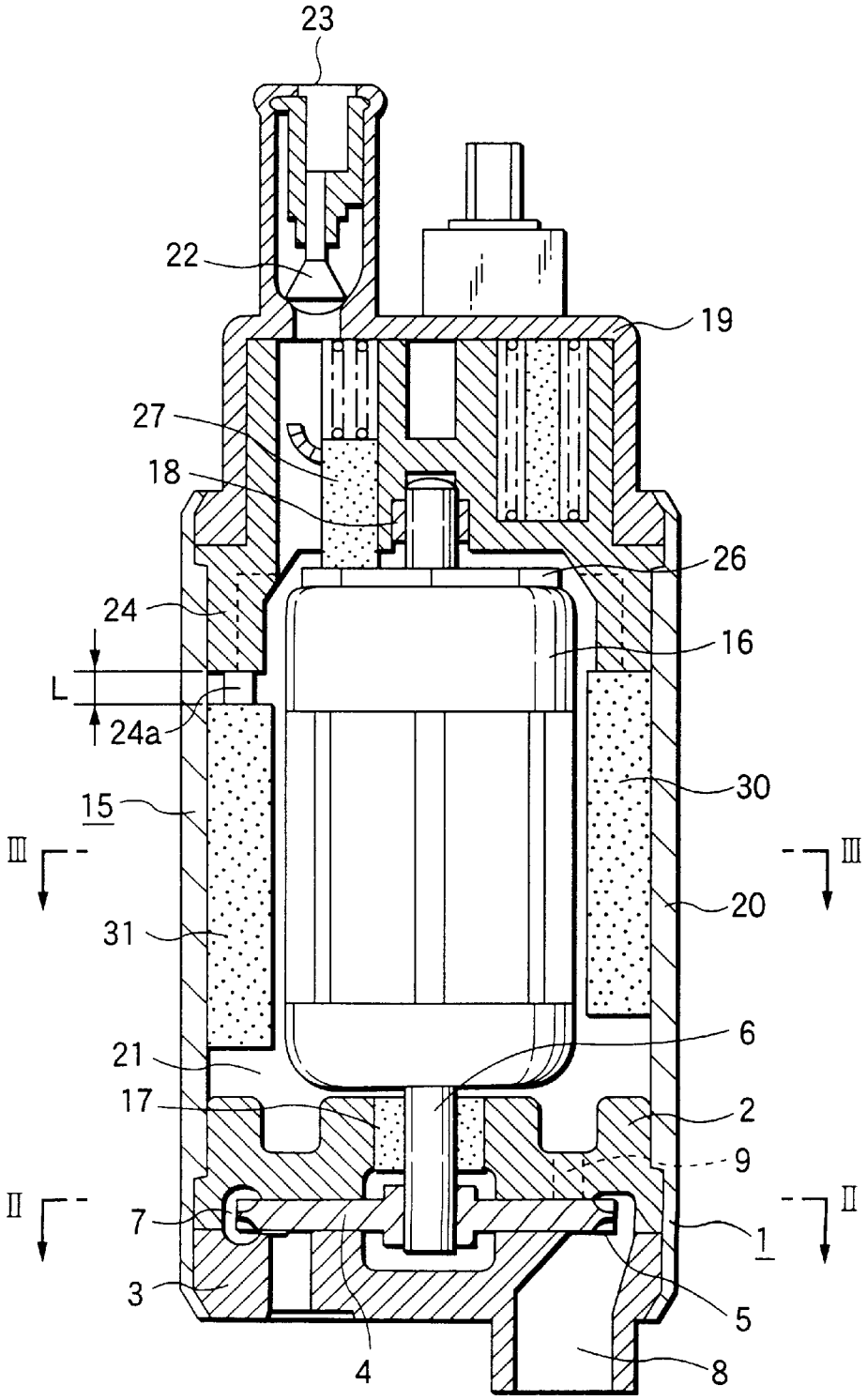
FIG. 1 is a vertical sectional view of an electric motor-driven fuel pump in one embodiment of this invention.
Figure 2:
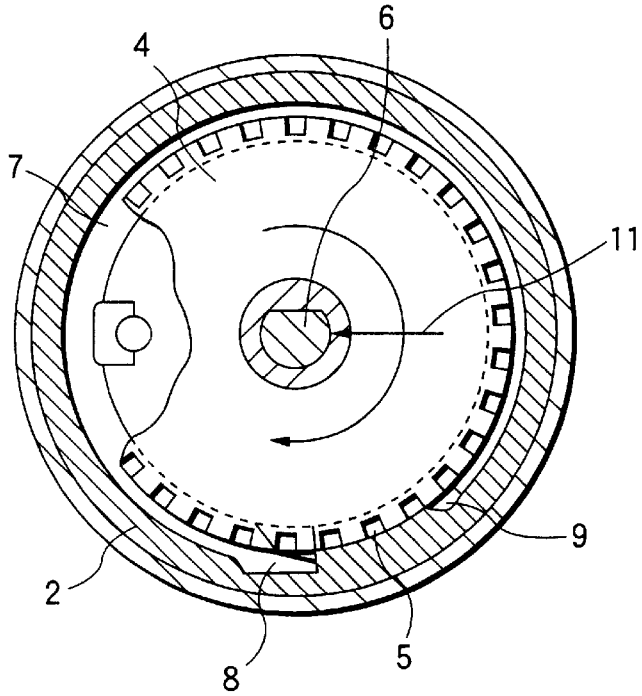
FIG. 2 is an enlarged sectional view taken along line II—II of FIG. 1.
Figure 3:
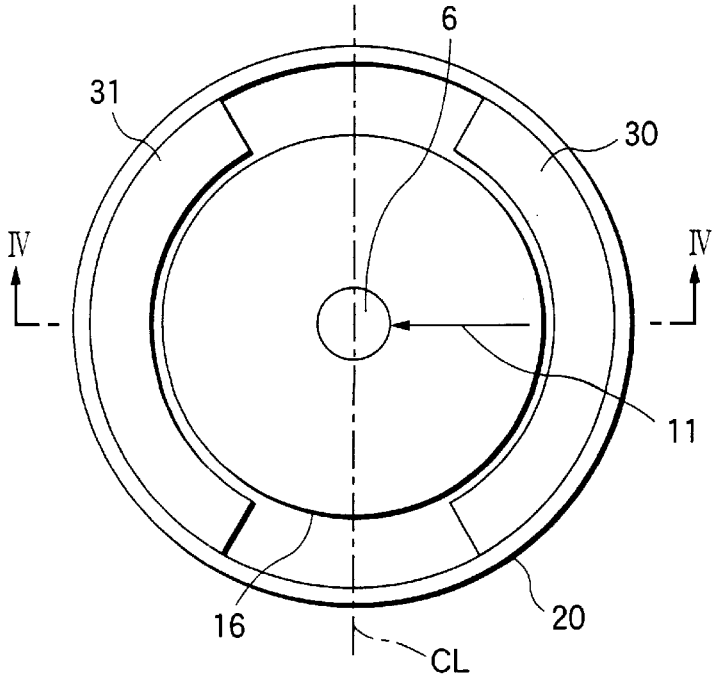
FIG. 3 is an enlarged sectional view taken along line III—III of FIG. 1.
Figure 4:
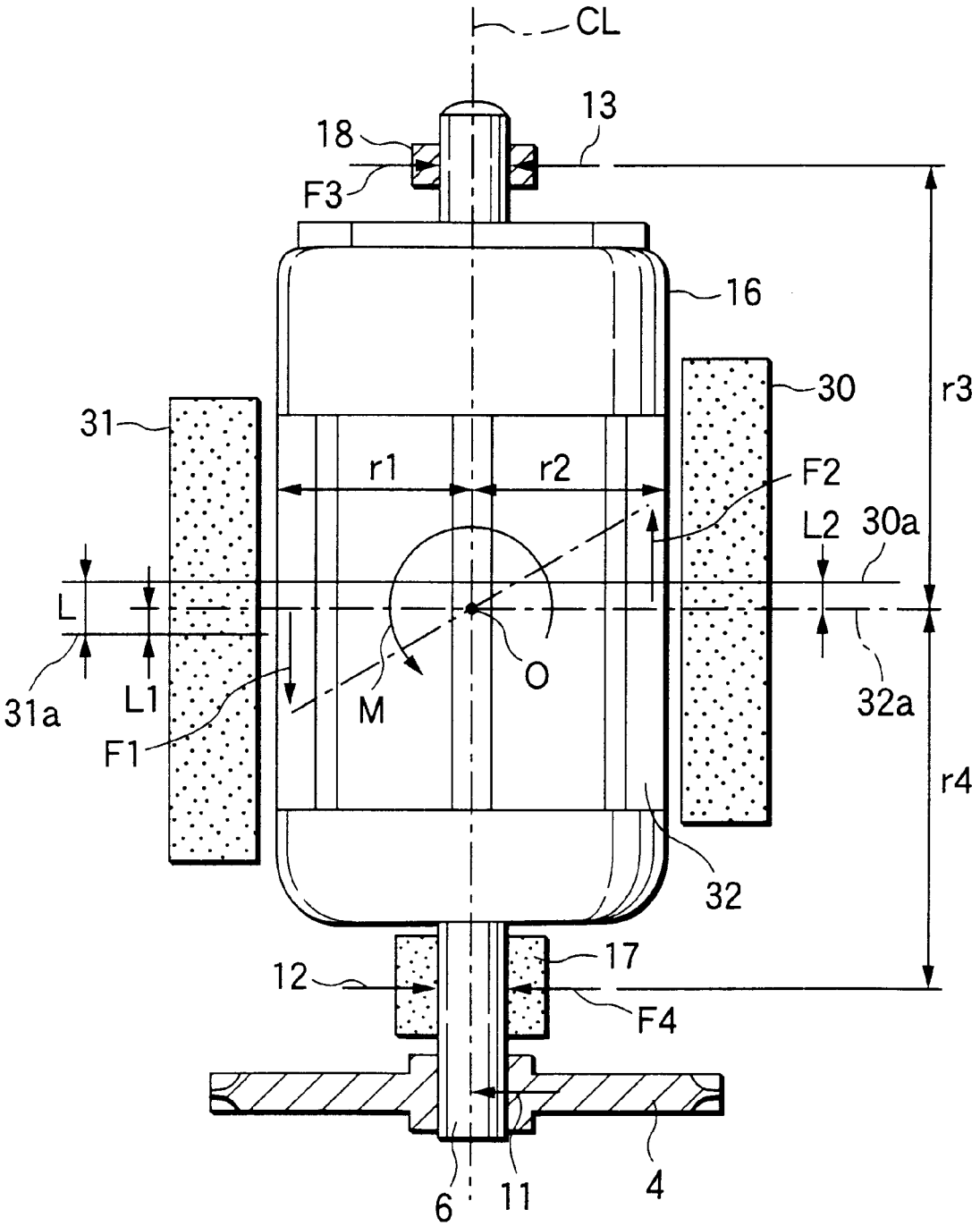
FIG. 4 is a partially main sectional side view taken along line IV—IV of FIG. 3.
Figure 5:
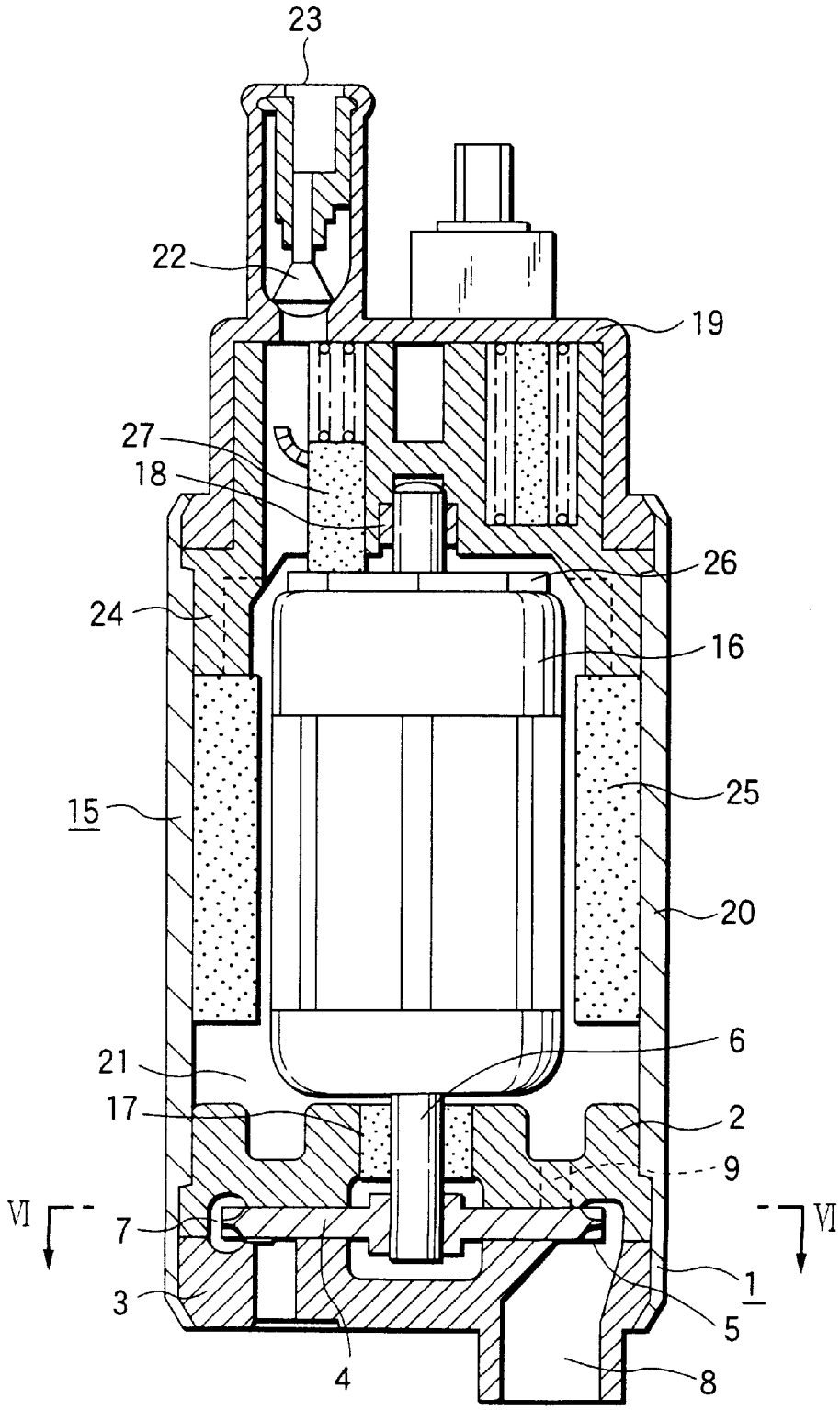
FIG.5 PRIOR ART
FIG. 5 is a vertical sectional view showing a conventional electric motor-driven fuel pump.
Figure 6:
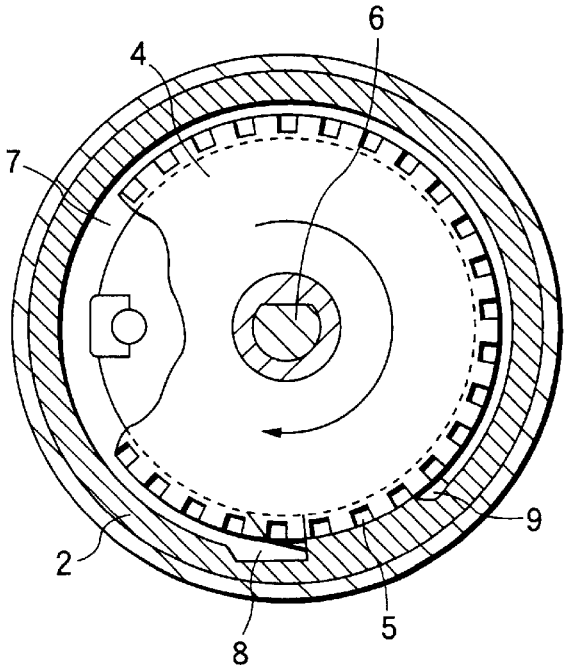
FIG.6 PRIOR ART
FIG. 6 is an enlarged sectional view taken along line VI—VI of FIG. 5.

FIG. 1 is a vertical sectional view of an electric motor-driven fuel pump in one embodiment of this invention, and FIG. 2 is an enlarged sectional view taken along line II—II of FIG. 1, and FIG. 3 is an enlarged sectional view taken along line III—III of FIG. 1, and FIG. 4 is a partially main sectional side view taken a long line IV—IV of FIG. 3. In the drawings, numerals 30, 31 are permanent magnets, and numeral 32 is a core of a rotor 16 which is formed of a magnetic material and induces a magnetic flux generated by the permanent magnets 30, 31, and numerals 1 to 13, 15 to 24, 26 and 27 are similar to that of the apparatus described in the background art and the description is omitted.

The permanent magnets 30, 31 are placed (FIG. 3) in both sides on the basis of a centerline CL of the rotor 16 perpendicular to a direction of a load 11 (hereinafter called "impeller load 11") radially applied to an impeller 4 by a pressure distribution within a pump flow path 7, and also an axial center 31*a* of the permanent magnet 31 is placed with the axial center offset to the side of the impeller 4 from an axial center 30*a* of the other permanent magnet 30, and are placed (FIG. 4) so that an offset distance L1 between the axial center 31*a* of the permanent magnet 31 and an axial center 32*a* of the core 32 is equal to an offset distance L2 between the axial center 30*a* of the permanent magnet 30 and the axial center 32*a* of the core 32 and offset directions are mutually the opposite directions.

Next, operations of the electric motor-driven fuel pump constructed thus will be described.

Fuel is sucked from a suction port 8 to one end of the pump flow path 7 by rotating and driving (FIG. 2) the impeller 4 in a clockwise direction by an electric motor 15, and this fuel is increased in pressure while flowing through the pump flow path 7 in a clockwise direction and passes a liquid chamber 21 from a discharge port 9 of the other end and is discharged (FIG. 1) from a liquid outlet 23 through a check valve 22.

Figure 7:
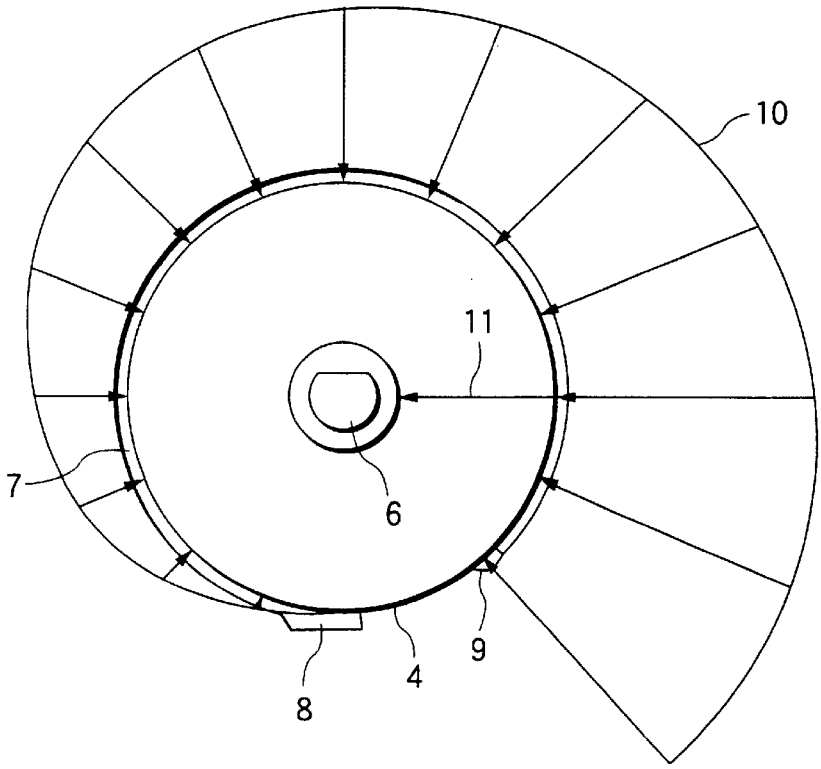
FIG. 7 is an illustration of a radial load distribution occurring in a pump flow path.
Figure 8:
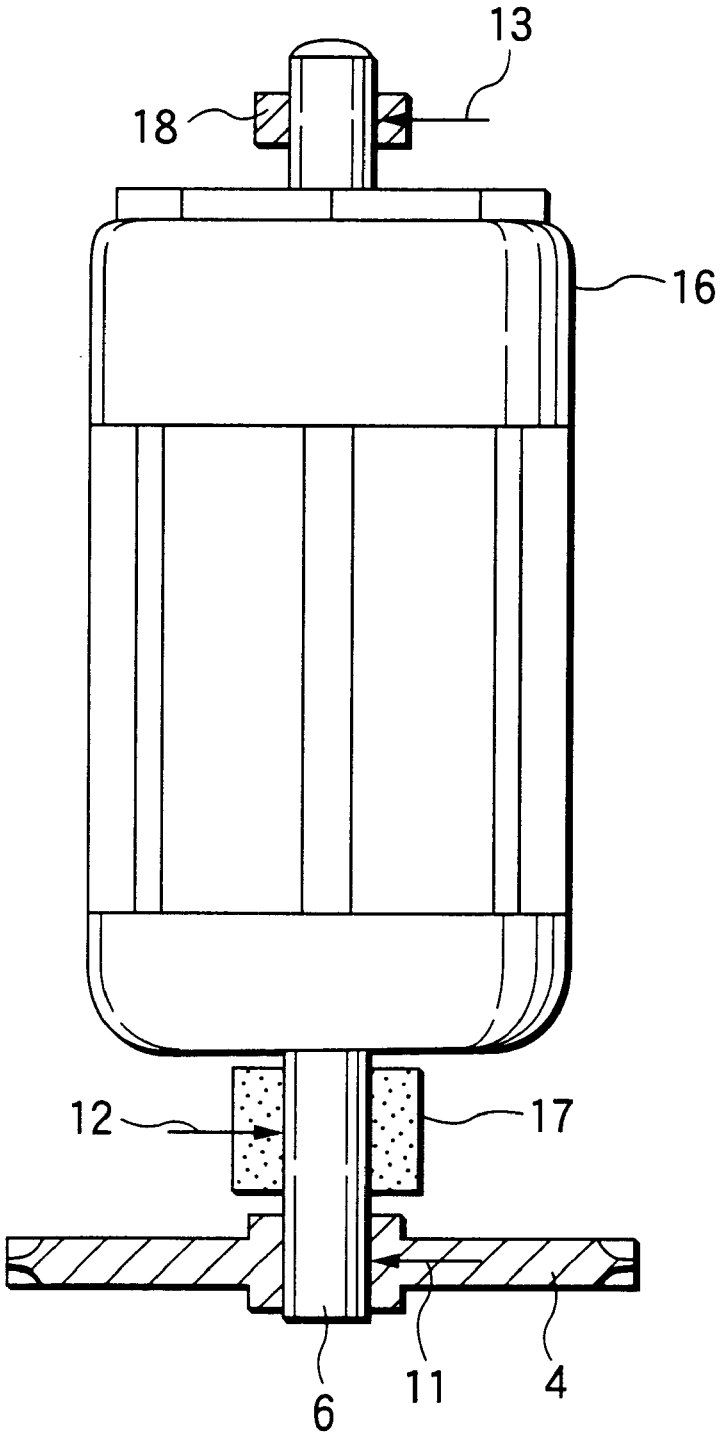
FIG. 8 is an illustration of bearing repulsion forces with respect to a load applied to an impeller.

Incidentally, at the time of the increase in pressure, in the outer circumferential edge of the impeller 4, a radial load distribution 10 (see FIG. 7) by a pressure distribution increasing from the suction port 8 toward the discharge port 9 occurs within the pump flow path 7 and as the resultant force, the impeller load 11 (FIG. 2) acts. As a result of that, as shown in FIG. 4, the impeller load 11 is applied to a center shaft 6 of the rotor 16 fitted in the impeller 4 and bearing repulsion forces 12, 13 act on the center shaft 6 from a bearing 17 and a bearing 18 rotatably supporting the center shaft 6. At the same time, a bearing load with the same size as that of the bearing repulsion forces 12, 13 in the opposite direction of the bearing repulsion forces 12, 13 acts on the bearing 17 and the bearing 18.

The axial center 31*a* of the permanent magnet 31 is placed with the axial center offset by the L1 to the side of the impeller 4 with respect to the axial center 32*a* of the core 32 which is the magnetic material, and a force in which the axial centers intend to become the same position occurs mutually on the permanent magnet 31 and the core 32. However, the permanent magnet 31 is fixed in a yoke 20 and as a result of that, a downward magnetic attraction force F1 acts on the core 32.

Also, the axial center 30a of the permanent magnet 30 is placed with the axial center offset by the L2 to the side opposite to the offset direction of the permanent magnet 31 with respect to the axial center 32*a* of the core 32 which is the magnetic material, and a force in which the axial centers intend to become the same position occurs mutually on the permanent magnet 30 and the core 32. However, the permanent magnet 30 is fixed in the yoke 20 and as a result of that, an upward magnetic attraction force F2 acts on the core 32.

As the above result, a turning moment M occurs on the rotor 16 around a rotation center of the intersection 0 of a line connecting terminal points of the F1 and F2 as vectors and the axial center 32*a* of the core 32. When it is assumed that a distance from the rotation center 0 to an initial point of the vector F1 is r1 and a distance from the rotation center 0 to an initial point of the vector F2 is r2, the turning moment M is indicated by the following expression.

$$M=F1\cdot r1+F2\cdot r2$$

By the turning moment M, a bearing repulsion force F4 acts on the center shaft 6 from the bearing 17 and a bearing repulsion force F3 acts on the center shaft 6 from the bearing 18. When it is assumed that a distance from the rotation center 0 of the rotor 16 to the bearing 18 is r3 and a distance from the rotation center 0 to the bearing 17 is r4, a relation between the F3, F4 and the turning moment M is indicated by the following expression.

$$F3\cdot r3+F4\cdot r4=M$$

The permanent magnets 30, 31 are placed in both the sides on the basis of the centerline CL of the rotor 16 perpendicular to a direction of the impeller load 11 radially applied to the impeller 4 occurring by the pressure distribution within the pump flow path 7, so that the bearing repulsion forces F3, F4 act in the opposite direction on the same line with respect to the bearing repulsion forces 12, 13 acting as a repulsion force of the impeller load 11.

As a result of that, by the bearing repulsion forces F3, F4 acting on the center shaft 6 from the bearings 17, 18, the bearing repulsion forces 12, 13 acting as the repulsion force of the impeller load 11 are relieved, and a bearing load by the impeller load 11 applied to the bearing 17 and the bearing 18 is also reduced.

In the embodiment, sizes of the bearing repulsion forces F3, F4 are different depending on an offset distance L added to the offset distance L2 between the axial center 30*a* of the permanent magnet 30 and the axial center 32*a* of the core 32 and the offset distance L1 between the axial center 31*a* of the permanent magnet 31 and the axial center 32*a* of the core 32, so that the offset distance L needs to be adjusted according to a size of the impeller load 11, but by integrally providing (FIG. 1) an adjusting protrusion 24*a* with the same size as that of the offset distance L obtained experimentally in a bracket 24, a fixed position of the permanent magnet 31 is determined by action of the adjusting protrusion 24*a* automatically when the bracket 24 is fitted in the yoke 20.

Incidentally, in the case of a fuel pump of an internal combustion engine for vehicle, the offset distance L is, for example, 0.5 to 5 mm.

Also, in the embodiment, the axial center 31*a* of the permanent magnet 31 is placed with the axial center offset to the side of the impeller from the axial center 30*a* of the permanent magnet 30 and it is placed so that the offset distance between the axial center 30*a* of the permanent magnet 30 and the axial center 32*a* of the core 32 is equal to the offset distance between the axial center 31*a* of the permanent magnet 31 and the axial center 32*a* of the core 32, but as viewed from the side generating the impeller load 11, even by placing an axial center of the opposite permanent magnet with the axial center offset to the side of the impeller 4, the bearing repulsion forces F3, F4 occur, so that a bearing load by the impeller load 11 can be reduced in a manner similar to the embodiment.

Further, in the embodiment, a size of an air gap between the core 32 of the rotor 16 and the permanent magnets 30, 31 is formed as the uniform size, but when this air gap size is formed so that the size is different in axial positions, for example, the air gap of the opposed surface to the core 32 of the permanent magnet 30 becomes narrow with an approach to the side of the impeller 4 and it is constructed so that a turning moment M occurs on the rotor 16, the bearing repulsion forces F3, F4 occur, so that a bearing load by the impeller load 11 can be reduced in a manner similar to the embodiment.

In the electric motor-driven fuel pump constructed as described above, the bearing load by the impeller load can be reduced and a decrease in efficiency of the fuel pump or wear in the bearings can be prevented.

INDUSTRIAL APPLICABILITY

An electric motor-driven fuel pump according to this invention comprises a disk-shaped impeller having blades in the outer circumferential edge, a pump casing assembly which rotatably supports the impeller and provides a pump flow path with a circular arc band shape extending along the blades of the impeller and a suction port and a discharge port opened in both ends of said pump flow path, a rotor having a center shaft fitted in the center of the impeller and a core fixed in said center shaft, bearings for rotatably supporting the center shaft of the rotor, and a pair of permanent magnets concentrically provided in an outer circumference of the rotor, and the permanent magnets are placed so that a load of a direction opposite to a direction of a load applied to the impeller by a pressure distribution within the pump flow path is generated in the rotor, so that a bearing load can be reduced and a decrease in efficiency of the fuel pump or wear in the bearings can be prevented.

Also, this invention relates to a reduction in the bearing load applied to the bearings of an electric motor of the electric motor-driven fuel pump, but when application is made to the case that a load is applied to a bearing in an electric motor other than the fuel pump, wear can be reduced in like manner.

What is claimed is:

1. An electric motor-driven fuel pump comprising a disk-shaped impeller having blades in the outer circumferential edge, a pump casing assembly which rotatably supports the impeller and provides a pump flowpath with a circular arc band shape extending along the blades of the impeller and a suction port and a discharge port opened in both ends of said pump flow path, a rotor having a center shaft fitted in the center of the impeller and a core fixed in said center shaft, bearings for rotatably supporting the center shaft of the rotor, and a pair of permanent magnets concentrically provided in an outer circumference of the rotor, characterized in that the permanent magnets are placed so that a load of a direction opposite to a direction of a load applied to the impeller by a pressure distribution within the pump flow path is generated in the rotor.

2. An electric motor-driven fuel pump as defined in claim 1, wherein the permanent magnets are placed in both sides on the basis of a centerline of the rotor perpendicular to a direction of a load applied to the impeller, and also as viewed from the side generating the load, an axial center of the opposite permanent magnet is placed with the axial center offset to the side of the impeller from an axial center of the other permanent magnet.

3. An electric motor-driven fuel pump as defined in claim 2, wherein an offset distance between an axial center of one permanent magnet and an axial center of the core is equal to an off set distance between an axial center of the other permanent magnet and the axial center of the core, and offset directions are mutually the opposite directions.

4. An electric motor-driven fuel pump as defined in claim 2, wherein the permanent magnet close to the impeller is positioned by an adjusting protrusion.

* * * * *